US006719874B1

(12) United States Patent
Gotkis et al.

(10) Patent No.: US 6,719,874 B1
(45) Date of Patent: Apr. 13, 2004

(54) ACTIVE RETAINING RING SUPPORT

(75) Inventors: Yehiel Gotkis, Fremont, CA (US); Aleksander A. Owczarz, San Jose, CA (US); Miguel A. Saldana, Fremont, CA (US); David Wei, Fremont, CA (US); Damon Vincent Williams, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 296 days.

(21) Appl. No.: 09/823,800

(22) Filed: Mar. 30, 2001

(51) Int. Cl.[7] ..... B24B 1/00; B24B 37/04
(52) U.S. Cl. ..... 156/345.14; 451/41
(58) Field of Search ..... 156/345.12, 345.14; 451/41, 66, 282–289

(56) References Cited

U.S. PATENT DOCUMENTS 6,245,193 B1 * 6/2001 Quek et al. ..... 156/345.14
6,371,833 B1 * 4/2002 Huckels et al. ..... 451/41
6,471,566 B1 * 10/2002 Mikhaylich et al. ..... 451/41

FOREIGN PATENT DOCUMENTS

EP 0776730 * 4/1997

* cited by examiner

*Primary Examiner*—P. HassanZadeh
*Assistant Examiner*—Sylvia R MacArthur
(74) *Attorney, Agent, or Firm*—Martine & Penilla, LLP

(57) ABSTRACT

A chemical mechanical planarization (CMP) system having a polishing pad, a carrier body for holding a wafer, a retaining ring, and an active retaining ring support is provided. The active retaining ring is defined by a circular ring having a thickness and a width. The circular ring is defined by an elastomeric material. The circular ring is configured to be placed between the retaining ring and the carrier body. The circular ring has a plurality of voids therein, and the plurality of voids are defined in locations around the circular ring. The circular ring has a compressibility level that is set by the elastomeric material and the plurality of voids.

16 Claims, 6 Drawing Sheets

ACTIVE RETAINING RING SUPPORT

BACKGROUND OF THE INVENTION

1. Field of the Invention

The present invention relates generally to chemical mechanical planarization (CMP) systems and techniques for improving the performance and effectiveness of CMP operations. Specifically, the present invention relates to a compressible ring suitable for use carriers having active retaining rings.

2. Description of the Related Art

In the fabrication of semiconductor devices, there is a need to perform CMP operations, including topography planarization, polishing, buffing and wafer cleaning. Typically, integrated circuit devices are in the form of multi-level structures. At the substrate level, transistor devices having diffusion regions are formed. In subsequent levels, interconnect metallization lines are patterned and electrically connected to the transistors to define the desired functional devices. As is well known, patterned conductive layers are insulated from other conductive layers by dielectric materials, such as silicon dioxide. At each metallization level and/or associated dielectric layer, there is a need to planarize the metal and/or dielectric material. Without planarization, fabrication of additional metallization layers becomes substantially more difficult due to the higher variations in the surface topography. In other applications, metallization line patterns are formed in the dielectric material, and then metal CMP operations are performed to remove over-burden materials, such as copper metallization.

In the prior art, CMP systems typically implement rotary, belt, orbital, or brush stations in which rotating tables (platens), belts, pads, or brushes are used to polish, buff, and scrub one or both sides of a wafer. Slurry is used to facilitate and enhance the CMP operation. Slurry is most usually introduced onto a moving preparation surface, e.g., belt, pad, brush, and the like, and distributed over the preparation surface as well as the surface of the semiconductor wafer being buffed, polished, or otherwise prepared by the CMP process. The distribution is generally accomplished by a combination of the movement of the preparation surface, the movement of the semiconductor wafer and the friction created between the semiconductor wafer and the preparation surface.

In a typical CMP system, a wafer is mounted on a carrier, which rotates to provide uniform and symmetrical material removal. The CMP process is achieved when the exposed surface of the rotating wafer is applied with force against a polishing pad, which moves or rotates in a polishing pad direction. Some CMP processes require that a significant force be used at the time the rotating wafer is being polished by the polishing pad.

Normally, the polishing pads used in the CMP systems are composed of porous or fibrous materials. Depending on the type of the polishing pad used, slurry composed of an aqueous solution containing different types of dispersed abrasive particles such as $SiO_2$, $CeO_2$ or $Al_2O_3$, may be applied to the polishing pad, thereby creating an abrasive chemical solution between the polishing pad and the wafer.

FIG. 1A depicts a cross-sectional view of an exemplary prior art CMP system. The CMP system of FIG. 1A depicts a carrier head 100 engaging a wafer 102 utilizing a retaining ring 101. The carrier head 100 is applied against the polishing pad surface 103*a* of a polishing pad 103 with a force F. As shown, the top surface of the retaining ring 101 is positioned above the front surface of the wafer 102. Thus, while the front surface of the wafer 102 is in contact with the polishing pad surface 103*a*, the surface of the retaining ring 101 is configured not to come into contact with the polishing pad surface 103*a*.

Several problems may be encountered while using a typical prior art CMP system. One recurring problem is called "edge-effect" caused by the CMP system polishing the edge of the wafer 102 at a different rate than other regions, thereby creating a non-uniform profile on the surface of the wafer 102. The problems associated with edge-effect can be divided into two distinct categories, namely "pad rebound effect" and "edge burn-off effect." FIG. 1B is an enlarged illustration of the pad rebound effect associated with the prior art. The pad rebound effect occurs when the polishing pad surface 103*a* initially comes into contact with the edge of the wafer 102 causing the polishing pad surface 103 to bounce off the wafer 102. As the moving polishing pad surface 103*a* shifts under the surface of the wafer 102, the edge of the wafer 102 cuts into the polishing pad 103 at the edge contact zone 104*c*, causing the polishing pad 103*a* to bounce off the wafer 102, thereby creating a wave on the polishing pad 103.

Ideally, the polishing pad 103 is configured to be applied to the wafer 102 at a specific uniform pressure. However, the waves created on the polishing pad 103 create a series of low-pressure regions such as edge non-contact zone 104*a*' and non-contact zone 104*a*, wherein the removal rate is lower than the average removal rate. Thus, the regions of the wafer 102 which came into contact with the polishing pad surface 103*a* such as the edge contact zone 104*c* and a contact zone 104*b*, are polished more than the other regions. As a result, the CMP processed wafer will tend to show a non-uniform undulating surface profile.

Further illustrated in FIG. 1B is the edge "burn-off." As the polishing pad surface 103*a* comes into contact with the sharper edge of the wafer 102 at the edge contact zone 104*c*, the edge of the wafer 102 cuts into the polishing pad 103, thereby creating an area defined as a "hot spot," wherein the pressure exerted by the polishing pad 103 is higher than the average polishing pressure. Thus, the polishing pad surface 103*a* excessively polishes the edge of the wafer 102 and the area around the edge contact zone 104 (i.e., the hot spots). The excessive polishing of the edge of the wafer 102 occurs because a considerable amount of pressure is exerted on the edge of the wafer 102 as a result of the polishing pad surface 103*a* applying pressure on a small contact area defined as the edge contact zone 104*c*. As a consequence of the burn-off effect, a substantially higher than the average removal rate is exhibited at the area within about 4 millimeters of the wafer edge area. 102. Moreover, depending on the polisher and the hardware construction, a substantially low removal rate is detected within the edge next lower contact pressure zone 104*a*', an area between about 3 millimeters to about 20 millimeters of the edge of the wafer 102. Accordingly, as a cumulative result of the edge-effects, an area of about 20 millimeters of the edge of the resulting post CMP wafers sometimes could be rendered unusable, thereby wasting silicon device area.

One way to compensate against edge effects is to use an active retaining ring. An active retaining rings is one that can be controlled so that the under surface of the retaining rings is about even with surface of the wafer being polished. To accomplish this, prior art active retaining rings utilize complex force application mechanisms that apply a reactive force to the retaining ring. These systems commonly use springs, air, or a combination of both, and are coupled to feedback electronics. Based on the feedback, the reactive force, which is commonly in terms of pressure, is fed to the active retaining ring.

Although such systems work relatively well, these systems also suffer in that their complexity makes them difficult to design and implement for symmetric repetitive CMP environments. As is well known, a retaining ring typically is round. As such, a system implementing springs or air must arrange a number of spring or air locations around the retaining ring. In doing so, circumstances will arise where the pressure being applied by one spring or air bladders will not match the pressure being applied by another spring or bladder. This difference can, of course, be attributed to any number of factors. Such factors can include uneven wear on springs, leaks in pneumatics, electronic signal delay, or even improperly entered control variables due to human interaction or programming. Also to fabricate air bladders with uniform thickness and geometry is a very complicated task. All of these factors, although controllable to certain degrees, introduce numerous potential problems to troubleshoot when inappropriate CMP results start appearing in processed wafers.

In view of the foregoing, a need therefore exists in the art for a chemical mechanical polishing system that substantially eliminates damaging edge-effects and their associated removal rate non-uniformities while efficiently facilitates slurry distribution.

SUMMARY OF THE INVENTION

Broadly speaking, the present invention fills these needs by providing an active retaining ring support. The active retaining ring support is preferably designed from an elastomeric material that will be applied behind a retaining ring. The elastomeric material, once prepared, is configured to provide a controlled and repeatable level of compressive deflection under the working conditions of the CMP operation. It should be appreciated that the present invention can be implemented in numerous ways, including as a process, an apparatus, a system, a device, or a method. Several inventive embodiments of the present invention are described below.

In one embodiment, chemical mechanical planarization (CMP) system having a polishing pad, a carrier body for holding a wafer, a retaining ring, and an active retaining ring support is disclosed. The active retaining ring is defined by a circular ring having a thickness and a width. The circular ring is defined by an elastomeric material. The circular ring is configured to be placed between the retaining ring and the carrier body. The circular ring has a plurality of voids therein, and the plurality of voids are defined in locations around the circular ring. The circular ring has a compressibility level that is set by the elastomeric material mechanical properties and the plurality of voids.

In another embodiment, an active retaining ring support is disclosed. The active retaining ring support is defined by an annular body that is made from an elastomeric material. The annular body has a plurality of recessed regions, and each of the plurality of recessed regions is spaced apart from respective regions. The annular body is configured to have a maximum compressibility level that is set by the number and size of the plurality of recessed regions. A wafer retaining ring is configured to sit over the annular body. The wafer retaining ring is thus capable applying a force to the annular body when contact is made with a polishing pad. The force is capable of compressing the annular body up to a maximum compressibility level as permitted by the mechanical properties of the material.

In yet another embodiment, a wafer carrier for use in chemical mechanical planarization is disclosed. The wafer carrier includes a carrier body and an annular body that is made from an elastomeric material. The annular body has a plurality of void regions, and each of the plurality of void regions is spaced apart from respective regions. The annular body has a maximum compressibility level that is set by the number and size of the plurality of void regions. An annular body support is also provided. The annular body support is connected to the carrier body and designed to receive the annular body. A wafer retaining ring is configured to mate with the annular body. The wafer retaining ring is capable applying a force to the annular body in response to being applied to a polishing pad. This force is capable of compressing the annular body up to a maximum compressibility level as permitted by the mechanical properties of the material.

In still another embodiment, a method for making an active retaining ring support for use in a chemical mechanical planarization (CMP) carrier head is disclosed. The active retaining ring support is configured to be placed between the carrier head and a retaining ring. The method includes: (a) determining a desired level of compression for a CMP process; (b) generating a mold for an annular ring; filling the mold with an elastomeric material; (c) curing the elastomeric material, thus producing an elastomeric annular ring; and (d) defining holes into the elastomeric annular ring to achieve the desired level of compression, the elastomeric annular ring defining the active retaining ring support.

The advantages of the present invention are numerous. Most notably, the active retaining ring support of the present invention is easy to make, does not require complex electronics, and does not wear as do metallic springs. Furthermore, once the compression level is set by defining holes or voids into the material and by appropriate selection of the material based on its mechanical properties, the compression level does not change over time, as the elastomeric material will naturally want to bounce back to its original uncompressed state so long as it is used within the limits of permanent deformation as set forth by its mechanical properties. Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, and like reference numerals designate like structural elements.

DETAILED DESCRIPTION OF THE PREFERRED EMBODIMENTS

The present invention defines an active retaining ring support. The active retaining ring support is preferably designed from an elastomeric material. In one embodiment, the elastomeric material is shaped to follow the outline of a retaining ring. To change the compressibility of the active retaining ring support, more or less voided shapes are made into the elastomeric material. As will be described below, different CMP processes will subject a retaining ring to different pressures. As an advantage of the present invention, the compressibility of the elastomeric material is preferably set to a degree that will enable an underside of a retaining ring to stay substantially co-planar with the surface of a wafer polished to reduce wafer edge effects. In the following description, numerous specific details are set forth in order to provide a thorough understanding of the present invention. It will be understood, however, to one skilled in the art, that the present invention may be practiced without some or all of these details. In other instances, well known process operations have not been described in detail in order not to unnecessarily obscure the present invention.

Figure 1A:
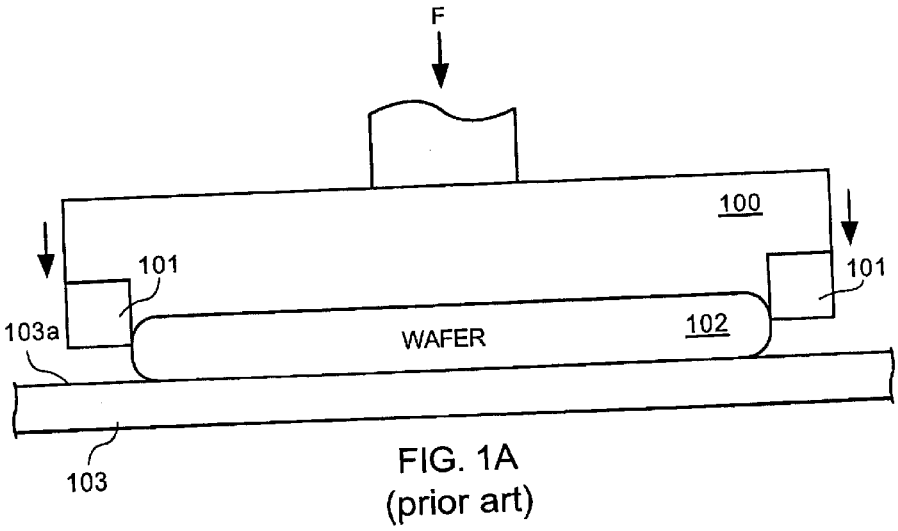
FIG. 1A (prior art)
FIG. 1A is an illustration of the prior art CMP system.
Figure 1B:
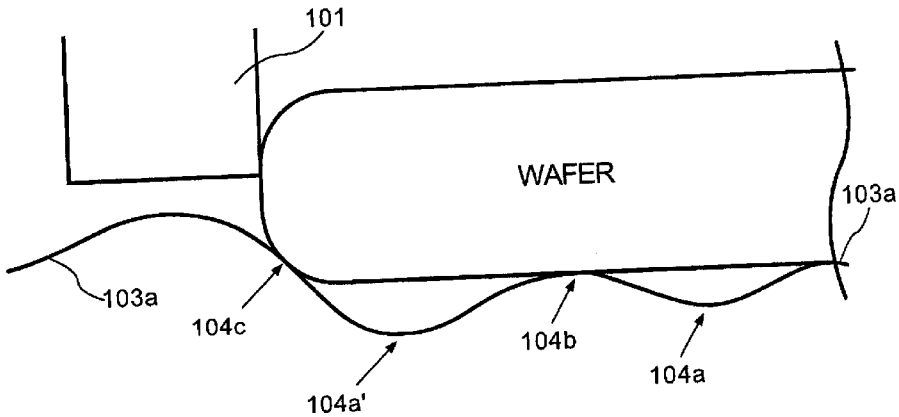
FIG. 1B (prior art)
FIG. 1B is an illustration of the pad rebound effect and edge burn-off effect associated with the prior art.
Figure 2:
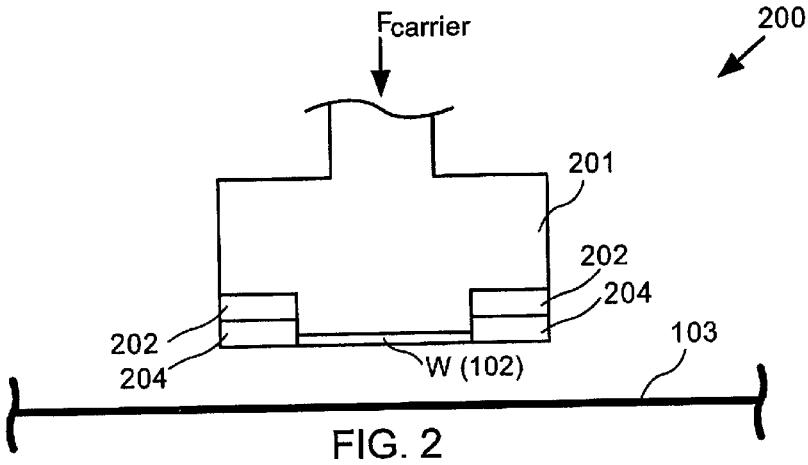
FIG. 2 illustrates a wafer carrier system 200, in accordance with one embodiment of the present invention.

FIG. 2 illustrates a wafer carrier system 200, in accordance with one embodiment of the present invention. The wafer carrier system 200 includes a carrier body 201, an active retaining ring support 202, and a retaining ring 204. A wafer 102 is thus retained by the retaining ring 204 during planarization operations. As discussed above, the carrier body 201 is configured to apply the wafer 102 onto the surface of the polishing pad 103. The polishing pad 103 can be any type of polishing pad such as, a belt type pad, or a table type pad.

The active retaining ring support 202 is configured to have elastomeric properties that will allow the retaining ring 204 to compress the active retaining ring support during CMP operations. As used herein, an elastomeric material is generically a rubber or an elastomer. An elastomer is, in one embodiment, a synthetic rubber. Synthetic rubber is typically a hydrocarbon polymeric material. The elastomer of the present invention preferably has the property of extensibility and thus can stretch and store energy so long as it is used within the limits of permanent deformation as set forth by its mechanical properties. Thus, even after the elastomeric material is compressed or stretched, it is able to quickly restore itself to its original state and does not show significant fatigue related thickness variations . Example of elastomeric materials include, rubber, synthetic rubber, like silicon rubber, polyurethanes, neoprene, etc.

Preferably, the elastomeric material of the active retaining ring support 202 is designed to a thickness and width that will provide the appropriate compressibility. In one embodiment, the thickness can range between about 2 mm and about 20 mm, and the width can range between about 5 mm and about 30 mm. A plurality of narrow rings could be used instead of a single wide one. Or, a plurality of ring segments. To adjust the compressibility of the active retaining support 202, voids, holes or recessed regions, wherein each of the removed material regions extends through to define a path through the circular ring can be made into the elastomeric material so as to provide added compressibility to the active retaining ring support. The compressibility is preferably selected for given CMP process conditions.

Figure 3:
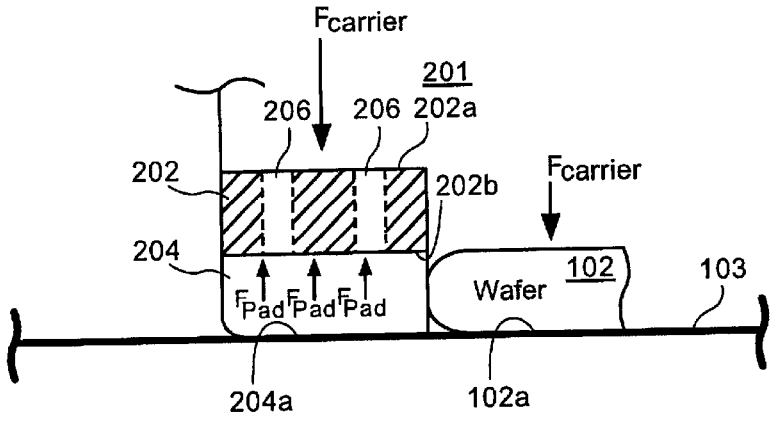
FIG. 3 illustrates a magnified view of the retaining ring, in accordance with one embodiment of the present invention.

FIG. 3 illustrates a magnified view of the retaining ring 204, the active retaining ring support 202, and a wafer 202 being applied to the polishing pad 103. In this illustration, the force (F) being applied to the carrier body 201 is thus applied to the wafer 102 as well as a top surface 202*a* of the active retaining ring support 202. Because the retaining ring 204 is being applied to the polishing pad 103, the retaining ring 204 will also be applying a force (Fpab) to a bottom surface 202*b* of the active retaining ring support 202.

The combination of the force being applied to the carrier body 201 and the reactive forces applied by the polishing pad 103 to the retaining ring 204, the active retaining ring support 202 will experience a degree of compression. The degree of compression is preferably adjusted so that a retaining ring bottom surface 204*a* will be substantially co-planar with an applied wafer surface 102*a* during processing. In this manner, it is possible to substantially eliminate or reduce edge effects that occur when the retaining ring 204 is not accurately aligned with the wafer 102.

Figure 4:
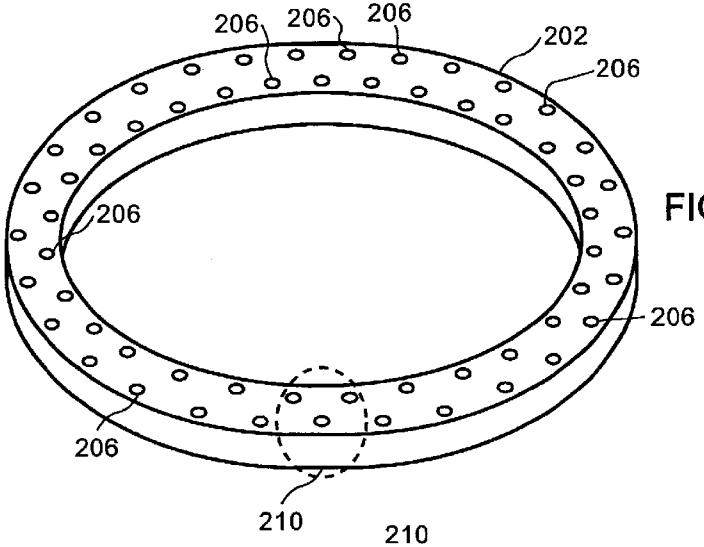
FIG. 4 illustrates a 3-dimensional view of the active retaining ring support, in accordance with one embodiment of the present invention.

FIG. 4 illustrates a 3-dimensional view of the active retaining ring support 202, in accordance with one embodiment of the present invention. In this illustration, the active retaining ring support 202 is in the form of an annular body or gasket which has a thickness and a width. Instead of an annular body, pieces of elastomeric material can also be placed under the retaining ring 204 at specific locations. The spacing between pieces will thus determine the overall compressibility.

Preferably, the dimension of the active retaining ring support 202 is configured so that it can be placed behind the retaining ring 204 and provide the degree of compressibility suited for a particular CMP operation(s). If more compressibility is desired, more voids 206 will be designed into the elastomeric material of the active retaining ring support 202.

Figure 5C:
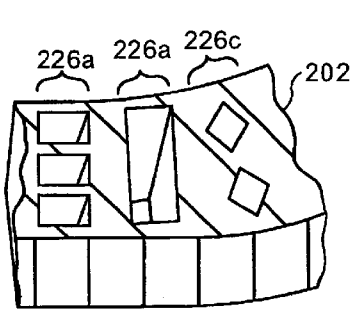
FIGS. 5A–5C illustrate exemplary voids and placements that can be used to change the compression level of the active retaining ring support.
Figure 5A:
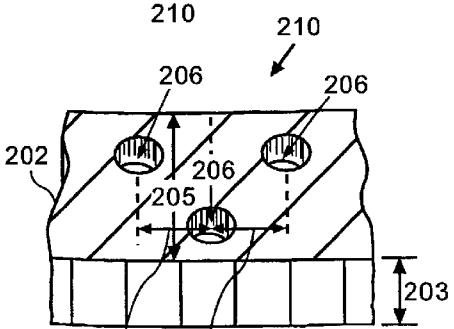

Thus, in applications where more compressibility is desired, substantially more voids 206 can be defined in the active retaining ring support 202. In terms of manufacturing, the active retaining ring support 202 can be made using liquid injected moldings that define an annular body without any voids 206. Once the degree of compressibility is determined, more or less voids 206 can be defined into the elastomeric material. Such voids 206 can be made by, for example, drilling at evenly spaced-apart intervals, cutting, stamping, or the like. In another embodiment, the active retaining ring support 202 can be molded to include the voids 206. In such a manufacturing process, there will be no need to define holes into the elastomeric material unless additional compressibility is desired. Exploded view 210 is shown in FIG. 5A wherein the ring will include a thickness 203 and a width 205. The circular voids 206 are also shown staggered at intervals 209 which continue around the parameter of the active ring support 202.

Figure 5B:
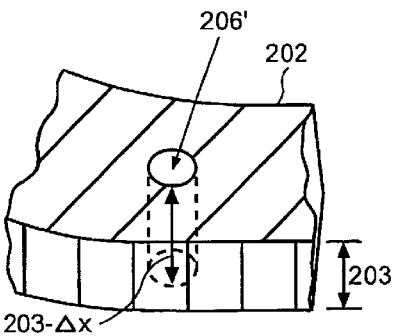

FIG. 5B shows another embodiment in which a circular void 206' is formed into the elastomeric material only part of the way through the thickness 203. In this example, the partial formation of the void 206' is shown by 203-ΔX. It should therefore be understood that the compressibility of the elastomeric material can be modified by simply removing a volume amount of material from locations around the active retaining ring support 202. FIG. 5C illustrates embodiments in which different shapes are formed into the elastomeric material of the active retaining ring support 202.

As illustrated, the plurality of voided squares can be formed into the elastomeric material as shown in 226*a*. Of course, more or fewer voided squares can be defined into the elastomeric material depending upon how much compressibility is desired for the particular active retaining ring support 202 and the CMP process to be performed. A set of diamonds 226*b* are also shown formed into the elastomeric material to emphasize that any shape can be formed into elastomeric material that defines the active retaining ring support 202.

Figure 6A:
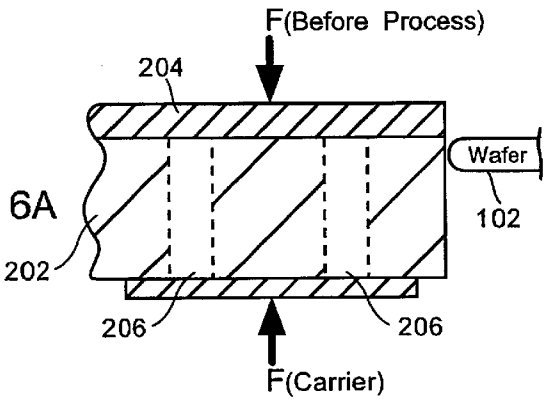
FIGS. 6A–6F illustrate before and after compression to achieve an about co-planar relationship between a bottom surface of a retaining ring and the applied surface of the wafer, in accordance with one embodiment of the present invention.
Figure 6B:
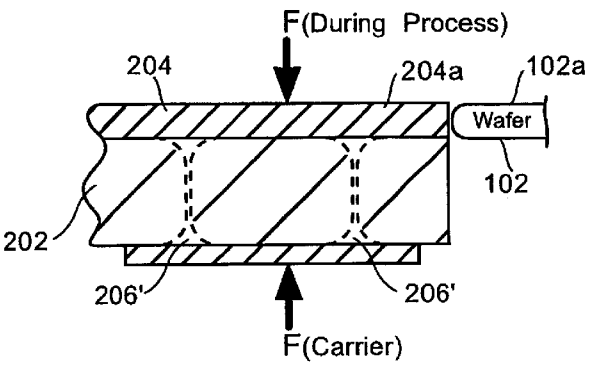

FIGS. 6A and 6B illustrate the compressibility of active retaining ring support 202 before and after a process force is applied to the retaining ring 204. As shown in FIG. 6A, before the process begins, the retaining ring 204 is not in contact with the polishing pad 103. As the retaining ring is applied against the polishing pad 103, a process force is applied to the retaining ring 204 by virtue of application to the polishing pad 103. In a preferred embodiment, it is desired that the applied wafer surface 102*a* be substantially co-planar with the retaining ring bottom surface 204*a*. To achieve this balance, voids, such as circular voids 206 are formed into the elastomeric material.

Figure 6C:
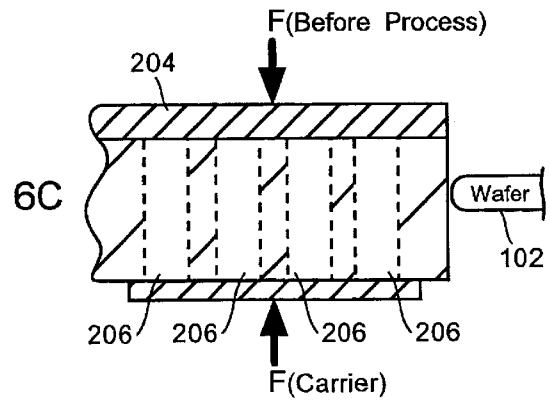
Figure 6D:
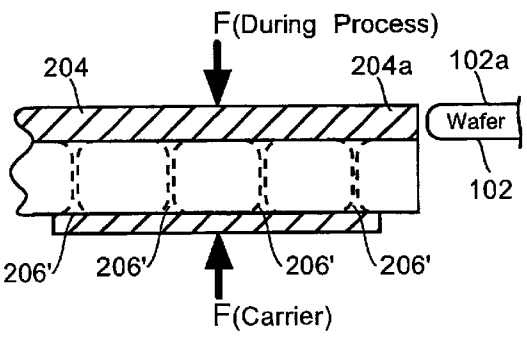

These voids, upon compression, will thus enable the elastomeric material to compress to the desired level so that the applied wafer surface 102*a* and the retaining ring bottom surface 204*a* become co-planar as shown in FIG. 6B. As shown in FIGS. 6C and 6D, other process parameters may require that additional voids 206 be formed into the elastomeric material of the active retaining ring support 202. In such a case, the elastomeric material of the active retaining ring support 202 will be allowed to experience more compressibility and thus still achieve a co-planar relationship between the applied wafer surface 102*a* and the retaining ring bottom surface 204*a*.

Figure 6E:
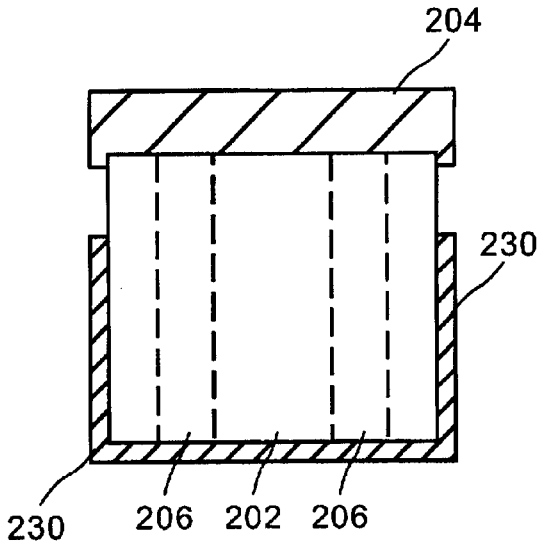
Figure 6F:
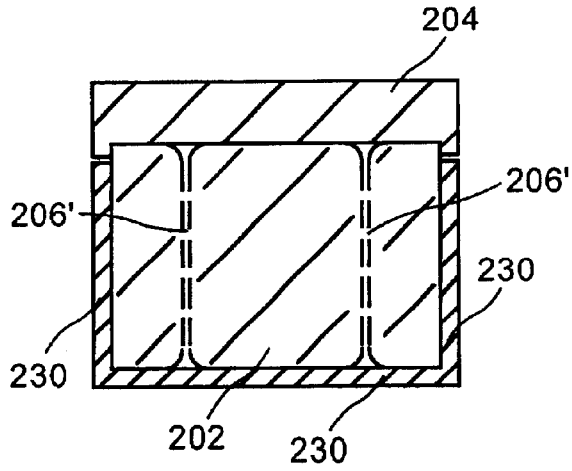

It should be understood that once the elastomeric material has been compressed and all voids have been substantially eliminated (due to sidewalls merging to close up voids), the elastomeric material will no longer compress. This is true because the elastomeric material will only compress to the extent it can expand outside of a containment region or support 230 as shown in FIG. 6F. FIG. 6E shows the elastomeric material in the uncompressed position, with the voids open and filled with air. Accordingly, once the retaining ring 204 has compressed the elastomeric material to the point that the voids 206 become compressed voids 206', the elastomeric material of the active retaining ring support 202 will no longer compress, thus reaching a maximum compression level. Accordingly, the active retaining ring support 202 can be designed to have a compressibility factor that will be maintained over continued use and thus, will not compromise the performance of a CMP operation which requires repetitive and reliable continued reproducibility.

Figure 7:
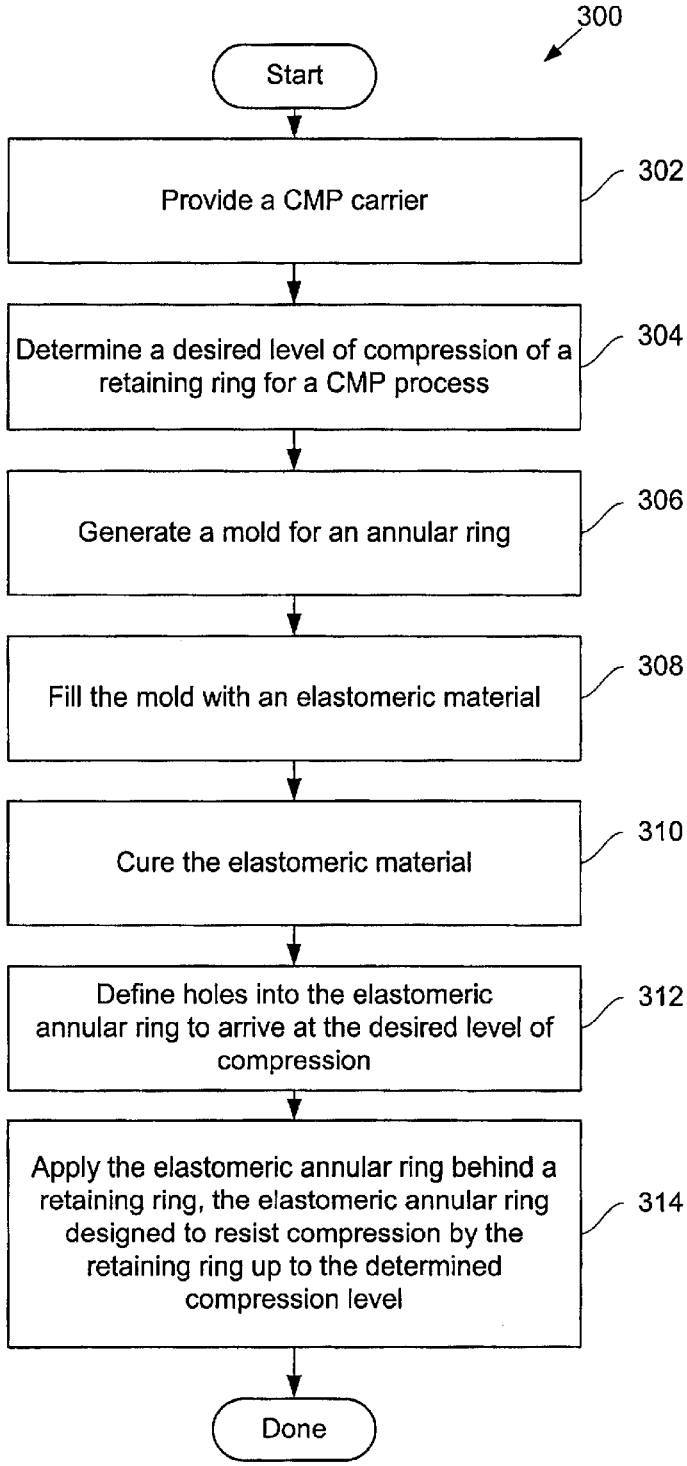
FIG. 7 is a flowchart diagram defining the method operations of making an active retaining ring support of the present invention.

FIG. 7 shows a flowchart diagram 300 of the process of making an active retaining ring support, in accordance with one embodiment of the present invention. The method begins at an operation 302 where a CMP carrier is provided. The CMP carrier, as described above, is designed to hold a wafer and apply the wafer to the surface of a polishing pad during planarization operations. The method moves to operation 304 where a desired level of compression of a retaining ring for a CMP process is determined.

For example, a determination must be made as to whether the CMP process is an oxide removal, a metal removal, or some other material removal. Other factors can include the level of metallization or oxide being removed (i.e., closer or further from the silicon substrate). The level of compression is determined such that a bottom surface of the retaining ring and the applied wafer surface remain at a substantially even level during the planarization process. By maintaining the retaining ring bottom surface and the applied surface of the wafer at about the same level, the aforementioned edge effects can be controlled and substantially minimized. Now the method moves to operation 306 where a mold for an annular ring is generated. The mold can be any conventional mold that is suited to hold a liquid material that will be cured. Accordingly, the method moves to operation 308 where the mold is filled with an elastomeric material. The elastomeric material is then cured in operation 310. Once the elastomeric material that is defined by the annular ring mold has been cured, the method moves to operation 312.

In operation 312, holes are defined into the elastomeric annular ring defining a path to arrive at the desired level of compression. As described above, the more holes or voids that are formed into the elastomeric material, the more compressive the material will be. Generally speaking, the holes can be defined using any suitable method, such as, drilling, punching using a form, cutting using a blade, and stamping. Of course, the holes are arranged around the annular ring in a distribution that enables the annular ring to have the same level of compression around its surface. The method now moves to operation 314 where the elastomeric annular ring is applied behind the retaining ring.

The elastomeric annular ring is designed to resist compression by the retaining ring up to the determined compression level. In this manner, the retaining ring can compress the annular ring up to the determined level that will place the bottom surface of the retaining ring about even with applied surface of the semiconductor wafer. In this manner, edge effects are substantially eliminated during the CMP process because the retaining ring is being kept at about the same level as the wafer.

Although the foregoing invention has been described in some detail for purposes of clarity of understanding, it will be apparent that certain changes and modifications may be practiced within the scope of the appended claims. For instance, the elastomeric material can by of any type, so long as it can be compressed and, once applied pressure is reduced, the elastomeric material will return to its original uncompressed position. Further, it should be understood that the voids used to modify the compressibility of the elastomeric can take on any shape or form. Accordingly, the present embodiments are to be considered as illustrative and not restrictive, and the invention is not to be limited to the details given herein, but may be modified within the scope and equivalents of the appended claims.

What is claimed is:

1. In a chemical mechanical planarization (CMP) system, having a polishing pad, a carrier body for holding a wafer, and a retaining ring, an active retaining ring support comprises:

a circular ring having a thickness and a width, the circular ring being defined by an elastomeric material, the circular ring being defined between the retaining ring and the carrier body, the circular ring having removed material regions at defined locations around the circular ring, the circular ring having a compressibility level that is defined by the elastomeric material and the plurality of removed material regions, wherein each of the removed material regions extends through to define a path through the circular ring.

2. The active retaining ring support of claim 1, wherein the ability of the circular ring to be compressed between the carrier body and the retaining ring is set by changing a quantity of removed material regions.

3. The active retaining ring support of claim 1, wherein the voids define air space within the circular ring.

4. The active retaining ring support of claim 3, wherein the voids have the same of one of circles, squares, slots, rectangles, and diamonds.

5. The active retaining ring support of claim 1, wherein a bottom surface of the retaining ring and an applied surface of the wafer are substantially co-planar when the circular ring is compressed.

6. The active retaining ring support of claim 1, wherein the circular ring is supported in a containment structure of the carrier body.

7. An active retaining ring support, comprising:

an annular body defined from an elastomeric material, the annular body having a plurality of recessed regions, wherein each of the recessed regions extend through to define a path through the circular ring, each of the plurality of recessed regions being spaced apart from respective ones, the annular body having a maximum compressibility level set by a number and size of the plurality of recessed regions; and a wafer retaining ring, the wafer retaining ring being configured to sit over the annular body, the wafer retaining ring being capable applying a force to the annular body, the force being capable of compressing the annular body up to the maximum compressibility level.

8. An active retaining ring support as recited in claim 7, wherein the annular body is compressed between a carrier body and the wafer retaining ring.

9. An active retaining ring support as recited in claim 8, wherein the carrier body is part of a CMP system for planarizing surface materials of a wafer.

10. An active retaining ring support as recited in claim 9, wherein the retaining ring has a bottom surface that is about co-planar with an applied wafer surface of the wafer.

11. An active retaining ring support as recited in claim 8, wherein the annular ring is supported in a containment structure of the carrier body.

12. An active retaining ring support as recited in claim 7, wherein the plurality of recessed regions are void of elastomeric material.

13. An active retaining ring support as recited in claim 7, wherein the plurality of recessed regions define air space within the annular body.

14. An active retaining ring support as recited in claim 7, wherein each of the plurality of recessed regions has one of a circle shape, a square shape, a slot shape, a rectangle shape, and a diamond shape.

15. A wafer carrier for use in chemical mechanical planarization, the wafer carrier comprising:

a carrier body;

an annular body defined from an elastomeric material, the annular body having a plurality of removed material regions, wherein each of the removed material regions extend through to define a path through the annular body, each of the plurality of removed material regions being spaced apart from respective ones, the annular body having a maximum compressibility level set by a number and size of the plurality of removed material regions;

an annular body support, the annular body support being connected to the carrier body and designed to receive the annular body; and a wafer retaining ring, the wafer retaining ring being configured to mate with the annular body such that the annular body is positioned between the annular body support and the wafer retaining ring, the wafer retaining ring being capable applying a force to the annular body in response to being applied to a polishing pad, the force being capable of compressing the annular body up to the maximum compressibility level.

16. A wafer carrier as recited in claim 15, wherein each of the plurality of removed material regions has one of a circle shape, a square shape, a slot shape, a rectangle shape, and a diamond shape.

* * * * *